US006000539A

United States Patent [19]

Stewart-Cox et al.

[11] Patent Number: 6,000,539

[45] Date of Patent: Dec. 14, 1999

[54] CIGARETTE PACK

[75] Inventors: Adrian Roy Stewart-Cox, Buckingham; Theodore Roland Philip Thomas, Bedfordshire; John Roger Sampson, Hertfordshire; Michael Patrick Parker, Bedfordshire, all of United Kingdom

[73] Assignee: Rothmans International Services Limited, London, United Kingdom

[21] Appl. No.: 09/147,210

[22] PCT Filed: May 2, 1997

[86] PCT No.: PCT/GB97/01221

§ 371 Date: Dec. 21, 1998

§ 102(e) Date: Dec. 21, 1998

[87] PCT Pub. No.: WO97/42098

PCT Pub. Date: Nov. 13, 1997

[30] Foreign Application Priority Data

May 7, 1996 [GB] United Kingdom ..... 9609484

[51] Int. Cl.[6] ..... A24F 15/00

[52] U.S. Cl. ..... 206/264; 206/268; 229/160.1

[58] Field of Search ..... 206/264, 268, 206/271; 229/160.1

[56] References Cited

U.S. PATENT DOCUMENTS

| | | | |
|---|---|---|---|
| 3,245,525 | 4/1966 | Shoemaker | 206/268 |
| 3,948,389 | 4/1976 | Molins et al. | 206/268 |
| 5,529,180 | 6/1996 | Paolucci et al. | 206/268 |

*Primary Examiner*—David T. Fidei

[57] ABSTRACT

Packaging for smoking articles such as cigarettes in a rigid, hinged-lidded carton includes a sealed barrier layer enclosure within the carton and a line of separation aligned with a lid-end edge of an inner frame of the carton so that the edge acts as a guide in shearing the barrier layer when opening the enclosure.

14 Claims, 8 Drawing Sheets

CIGARETTE PACK

This invention relates to packaging for smoking articles such as cigarettes, cigars or cigarillos and particularly though not exclusively for cigarettes. For convenience we will refer to the smoking articles as cigarettes in this specification.

It is highly desirable that packaged cigarettes should be protected from deterioration due to excessive or reduced humidity and should not lose flavour by exposure to air or moisture. In a conventional cigarette carton the primary barrier layer is afforded by an external wrap of transparent plastics material, usually a polypropylene, which can be removed by use of a tear strip when the smoker wishes to open the carton. Inside such cartons a secondary barrier is provided by a composite of thin paper and metal foil which immediately surrounds the cigarettes but which being merely folded around them is not a sealed enclosure and indeed usually has a completely separate portion at the top which is lifted out and discarded by the user when he wishes to get access to the cigarettes.

In the United States where "soft packs" of cigarettes are prevalent, the outer layer of such packs may be a metallised plastics layer or a laminate which includes a metal layer, both of which have very superior barrier properties and which when appropriately printed can have an attractive appearance. It is completely sealed round the pack. However the material being soft and flexible can be punctured or torn; furthermore, soft packs are not regarded as commercially attractive in other parts of the world. Examples of a soft pack are to be seen in GB-A-1471086 and U.S. Pat. No. 5,427,235, the latter showing a metallised external barrier material.

An object of the present invention is to provide a pack for cigarettes which has a highly effective, sealed, barrier layer which is contained within a protective shell of a carton; the carton may optionally be overwrapped with a conventional transparent or other barrier layer.

The internal barrier layer is formed of a plastics/metal laminate or of a metallised plastics material. Both of these have superior barrier properties and attractive appearance. The carton is of the hinged-lid type, namely one in which the lid is hinged adjacent a rear or side wall of the carton, has side walls which extend towards the opposite panel and which when opened by rotation along its hinge line gives access to the ends of a collocation of cigarettes within the carton so that they can be withdrawn essentially along the direction of their own axis, if appropriate after removal of an internal barrier layer.

An internal barrier of metal-containing composite material can be seen in U.S. Pat. No. 4,286,712 and U.S. Pat. No. 5,001,325 (FIGS. 7 and 8) with in both cases a tearable flap being defined by lines of weakness and being torn upwardly by the user pulling directly or indirectly upon the bottom edge of that flap. GB-A-2038765 has an aroma-tight enclosure within a hinged-lid container, openable by pulling on a pull tab to cause separation of the material of the enclosure along a line parallel with one edge of the container.

In the invention, a barrier layer and an outside edge forming a sealed enclosure is interposed between the cigarettes and a carton and at least a portion of an edge of the carton is immediately adjacent one edge of a separation line of the barrier layer and outside that edge. Usually the barrier layer will have a tear strip one edge of which is on the aligned separation line; when the tear strip or other pull means on the barrier layer is pulled outwardly by the user in order to separate the top portion of the barrier enclosure from its lower portion, the aligned edge acts as an "anvil" supporting the barrier layer against outward movement and thereby assisting a positive and clean separation of the upper portion of the barrier layer along the predetermined path determined by and aligned with the said edge of the carton.

The said edge of the carton is preferably provided by an inner frame member.

The inner frame member may be the sole member of the inner frame; but in a second and preferred embodiment of the invention the inner frame has two members, as an inner and as an outer, and the barrier layer is sandwiched between the two members, with the outer of the two members providing the aligned edge and the inner of the two members providing guidance shoulders fitting within and sliding upon side walls of the lid of the carton as that is pivoted about the hinge.

The barrier layer may be provided with a line or lines of weakening to further assist definition of the line of separation, but normally such lines of weakening will not be needed, given the support afforded the barrier layer during severance by the inner frame edge.

In most embodiments of the invention the line of separation and the aligned edge will both be straight; however, particularly if lines of weakening are provided, some degree of curvature may be achieved.

Particular embodiments of the invention will be described with reference to the accompanying drawings wherein.

Figure 1:
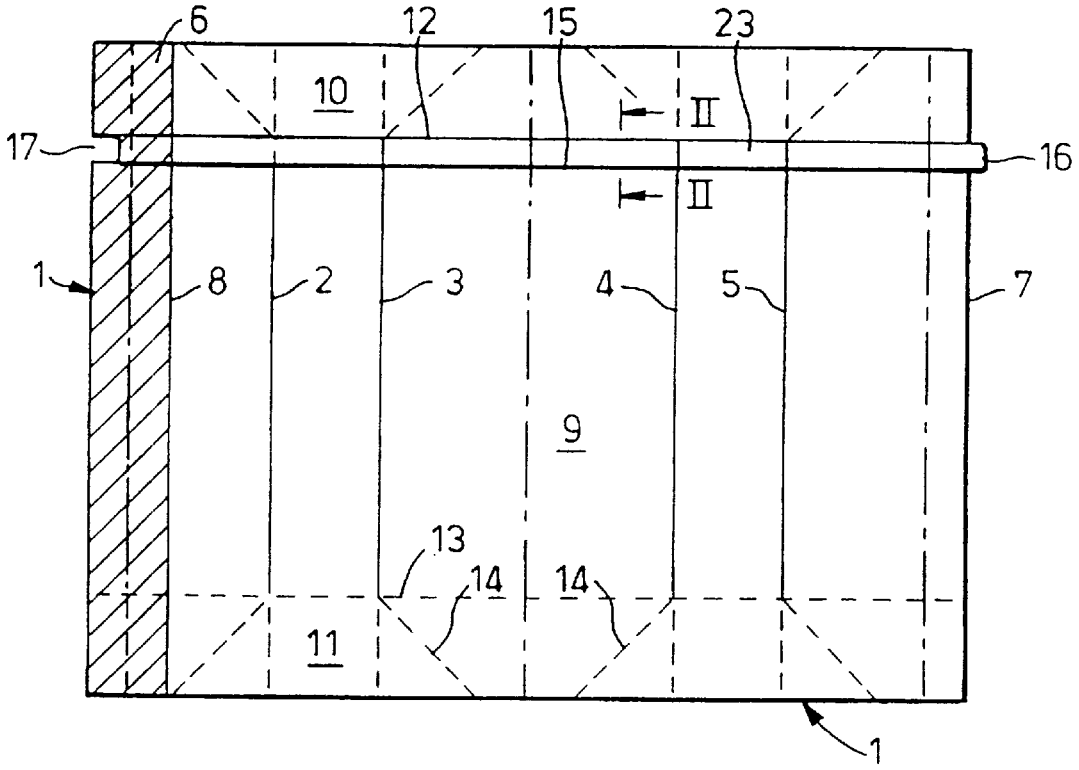
FIG. 1 is a face view of a blank for a first embodiment of barrier layer enclosure.

Referring first to FIG. 1, a blank 1 of a laminate to be described is for a barrier enclosure and is to be folded, on machinery known per se, on fold lines 2,3,4,5 to form a tubular wrap to surround an assembly of for example twenty cigarettes which may be contained in a known tray or the wrap may be formed in known manner, around a hollow mandrel containing the cigarettes. The wrap is secured by a seam with heat-sealable or cold-sealable material in the cross hatched area 6, with edge 7 of the blank brought to edge 8 of the heat-sealable area. The seam formed by the overlap of area 6 and edge 8 is peelable because the strength of adhesion is lower than the tear strength of the laminate. The seam is positioned at a front major face of the wrap and panel 9 of the wrap is to be the backface within the carton. In alternative forms the seam could be elsewhere, and particularly in the region of a front corner of the carton.

End flaps 10,11 are folded on fold lines 12,13 over the ends of the packed cigarettes, with folds being formed in known manner on diagonal fold lines such as 14, and are sealed in known manner, either between the plastics materials of the laminate or via a known sealable coating. Fold line 12 is at one edge of a tear strip 23 which traverses all of the fold lines 2–5 as well as sealed area 6 as far as the edge 7, with a tab 16 extending beyond that edge, a corresponding indentation 17 in the sealed area 6 serving both to weaken that area and to avoid waste of material in the cutting of the blanks. At the edge 7 there are short cuts through the material at each of the lines 12,15 which show the upper and lower edges of the tear strip, to give clean initiation of a tear.

Figure 2:
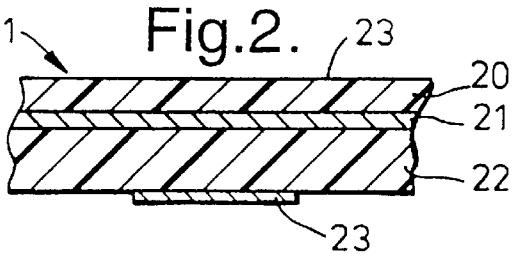
FIG. 2 is a section on the plane II—II of FIG. 1.

A suitable material as shown in FIG. 2 is a laminate known per se in which layer 20 is polyester of a thickness of 12 $\mu$m, layer 21 is aluminium foil of a thickness of 8 $\mu$m and layer 22 is polyethylene of a thickness of 25 $\mu$m. An alternative is for example aluminium foil of 15 $\mu$m thickness with polypropylene of 12 $\mu$m thickness on both faces. Tear strip 23 is on the surface innermost when the blank is made up.

Figure 1A:
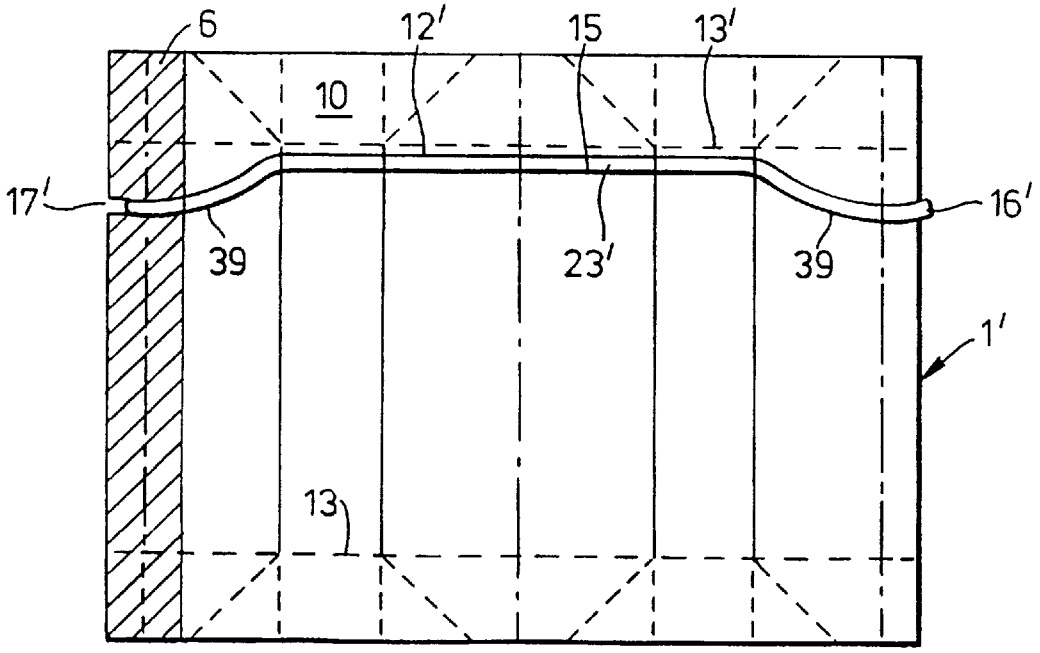
FIG. 1A is a face view of a variant.

In a variant shown in FIG. 1A, strip 23' is slightly curved in part, with tab 16' matching recess 17'. Here, cut line 12' is spaced from the fold line 13' with the flap 10.

It is possible for one or more lines of weakening, continuous or discontinuous, to be provided in the laminate which further guide and permit ready tearing of the laminate along the strip 23, 23' precisely defined; however the lines of weakening must not affect the barrier properties of the laminate which are primarily due to the metal layer 21 and thicker polyethylene or polypropylene layer 22.

A particularly advantageous method is to cut through the material of layer 20 by laser without affecting or distorting the metal layer 21. For methods of making such cuts see e.g. U.S. Pat. No. 5,010,231.

Thus, when the blank is made up into a wrap surrounding an assembly of cigarettes whether with an intermediate tray or not, the strip 23,23' terminating in the tab 16,16', can be torn out by the user pulling on that tab thereby to detach the whole of the top of the barrier enclosure and reveal the cigarettes. Initiation of the tear is assisted by the reduced width of the heat-seal 6 under the tab 16,16', due in part to recess 17,17', and by the through-cuts adjacent the edge 7.

Figure 4:
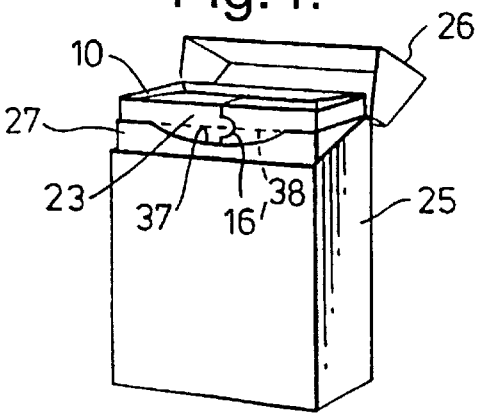
FIG. 4 is a perspective view of an assembled carton including the frame and made up barrier package.

The wrapped collocation of cigarettes is intended to be placed in a substantially hard carton of the flip-top type as indicated at 25 in FIG. 4. The carton is shown with its lid 26 open exposing the top of the wrapped pack of cigarettes and the tab 16.

Such cartons usually have an inner frame.

Figure 3:
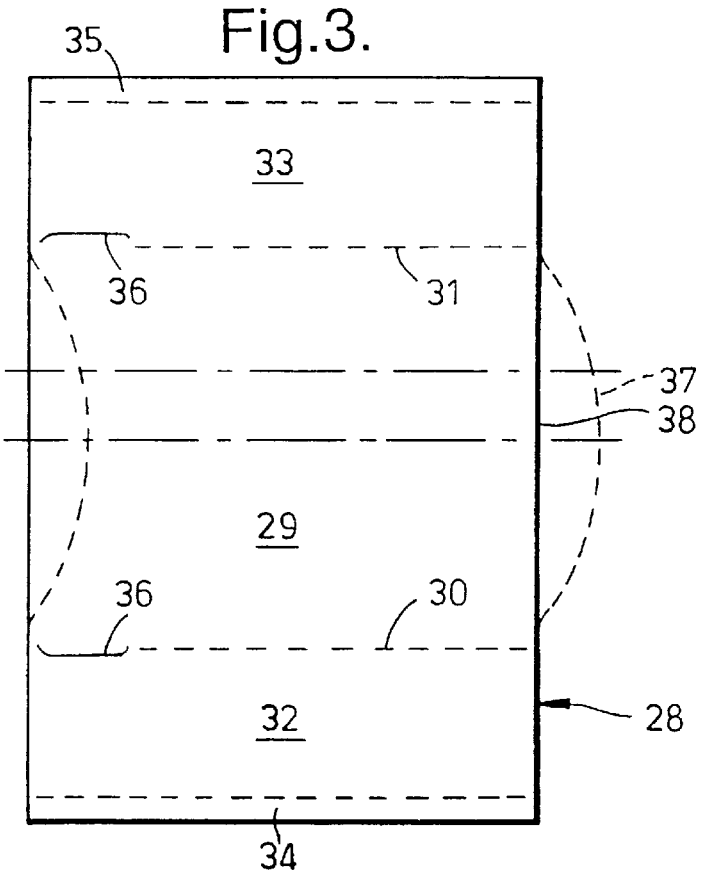
FIG. 3 is a face view of a blank for an inner frame of a carton.

In the present embodiment, the inner frame is formed from the blank 28 seen in FIG. 3 which has a front panel area 29 terminating at corner fold lines 30,31 to give side panels 32,33 and a rim 34,35 to underlie the back panel of the carton. Ears 36 known per se project slightly outwardly at the upper corner of the inner frame once assembled and act to engage with the lid 26 when the latter is closed.

The carton has an edge 38 which is closely aligned in the made up carton with the lower edge of the strip 23; in dotted lines there is shown a curved edge 37, the shape of which corresponds to curvature 39 of the strip 23' adjacent the tab 16' (FIG. 1A). When the wrapped pack is placed in the carton and the user pulls on the tab 16 a clean break along the line 15 is assisted by the support given immediately adjacent, and corresponding to, that line by the edge 37,38 of the carton, here, as is preferred, being provided by the inner frame 28.

In this way there is achieved a wrap for cigarettes in which the advantageous barrier properties of the multi-layer composite are not affected while allowing ready access to the contents of the wrap when desired.

The tear strip 23 is known per se, and is of higher tensile strength than the composite making up the barrier layer.

It will be seen that in that first embodiment the upper edge of the inner frame lies somewhat further up the carton than is conventional, thus not revealing as much of the ends of the collocation of cigarettes as the consumer is accustomed to seeing.

The embodiment to be described with reference to FIG. 5 onwards has a more conventional appearance and this is achieved by having an inner frame which has two members, an inner and an outer.

Figure 5:
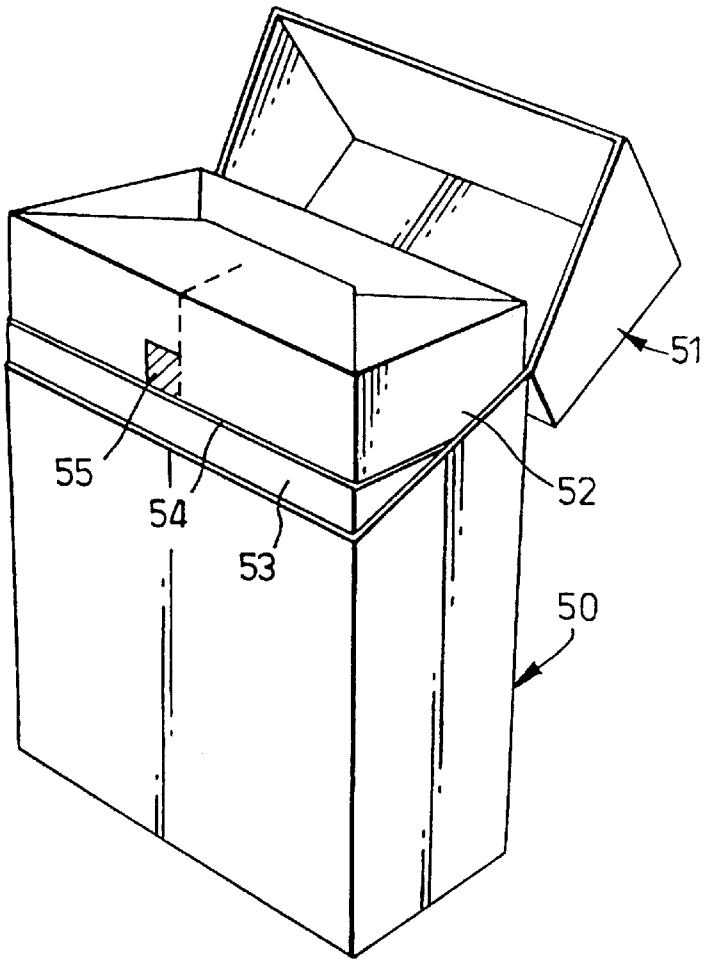
FIG. 5 is a perspective view of a second embodiment of package.

In FIG. 5 a carton 50 is shown with its lid 51 hinged open to expose the upper portion 52 of a sealed barrier enclosure and an upper edge portion of an inner frame member 53. The upper edge 54 of that member 53 is at or close to a level conventional for flip-top cartons so that, when the user pulls on a tab 55 of the barrier layer enclosure and separates the upper portion 52 of that enclosure from the lower, the appearance of the carton is that seen in FIG. 11. The structure of a blank for the barrier enclosure of the second embodiment is seen in FIG. 6.

This blank for the enclosure 52 is very similar to that seen in FIG. 1, with fold lines 2–5 running parallel to edges 7 and line 8 beyond which is an area 6 of heat seal material. Fold lines 12,13 are to define the top and bottom edges of the enclosure formed by the blank, and diagonal fold lines 14 permit the formation in known manner of the overlapped corners of the enclosure.

A tear strip 23" may project at one edge to provide a tab 16" (55,55',55" in the perspective figures) with a corresponding recess 17" at the opposite edge, or a non-projecting tab may be formed by cuts into that edge. The upper edge 12" of the tear strip is substantially spaced from the fold line 13 and the line 15" of its lower edge will be aligned in the assembled carton both with the base of a vee of an inner portion of an inner member of the inner frame and with an upper edge of an outer member of the inner frame, in a manner to be described.

Figure 6:
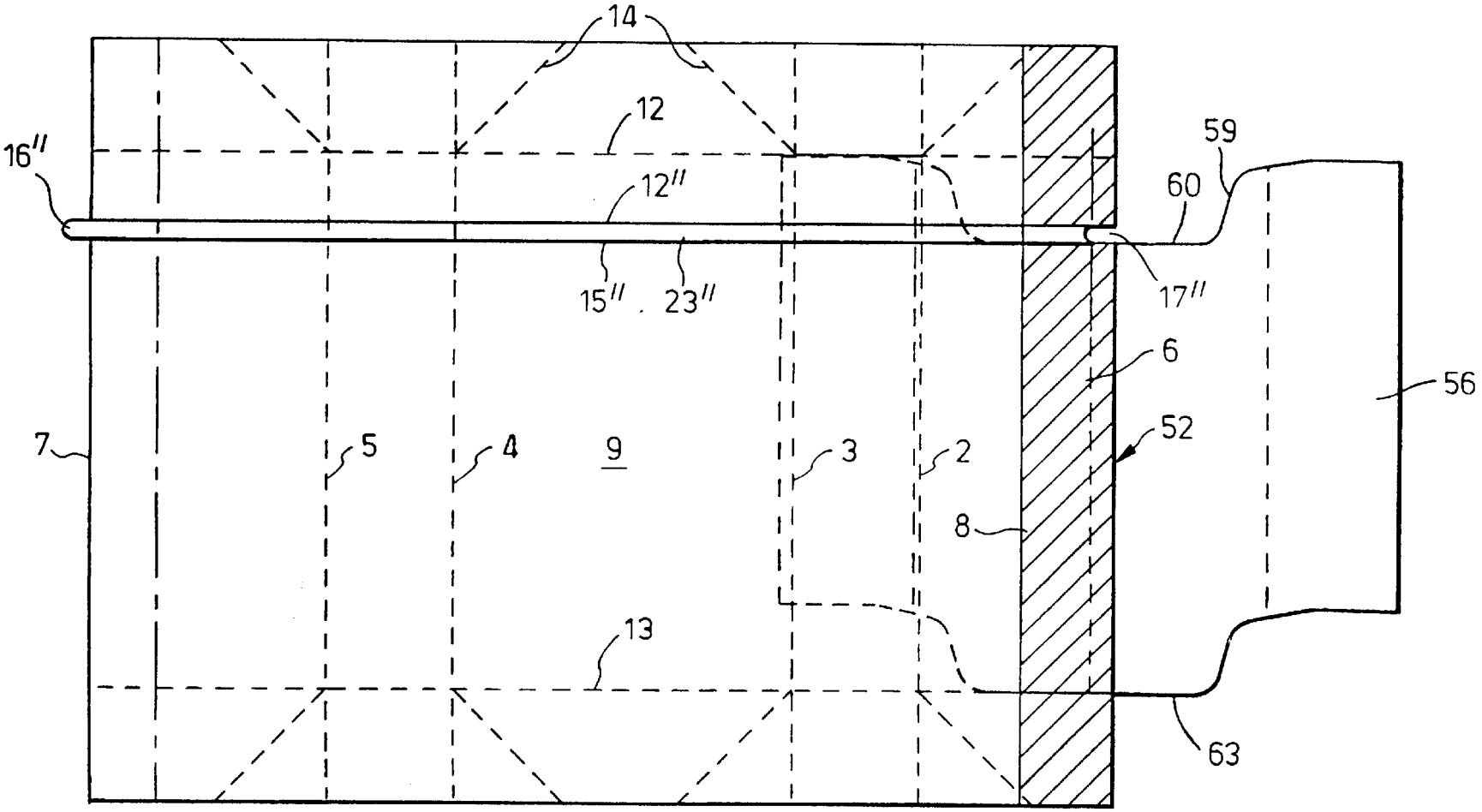
FIG. 6 is a face view of a blank for the barrier enclosure of the second embodiment in juxtaposition with an inner member of an inner frame.

FIG. 6 shows in dotted lines the relative positioning of inner frame member 56 with its inclined surfaces 59 to form a vee, and with the base 60 of that vee aligned with the lower edge 15" of the tear strip 23".

The pull tab and its associated seam need not be positioned at the centre of the major face of the pack but may be towards one side, for example towards the right hand side as shown, with the user pulling leftwards across the major face. Such embodiments are seen in FIGS. 7 to 10.

Figure 7:
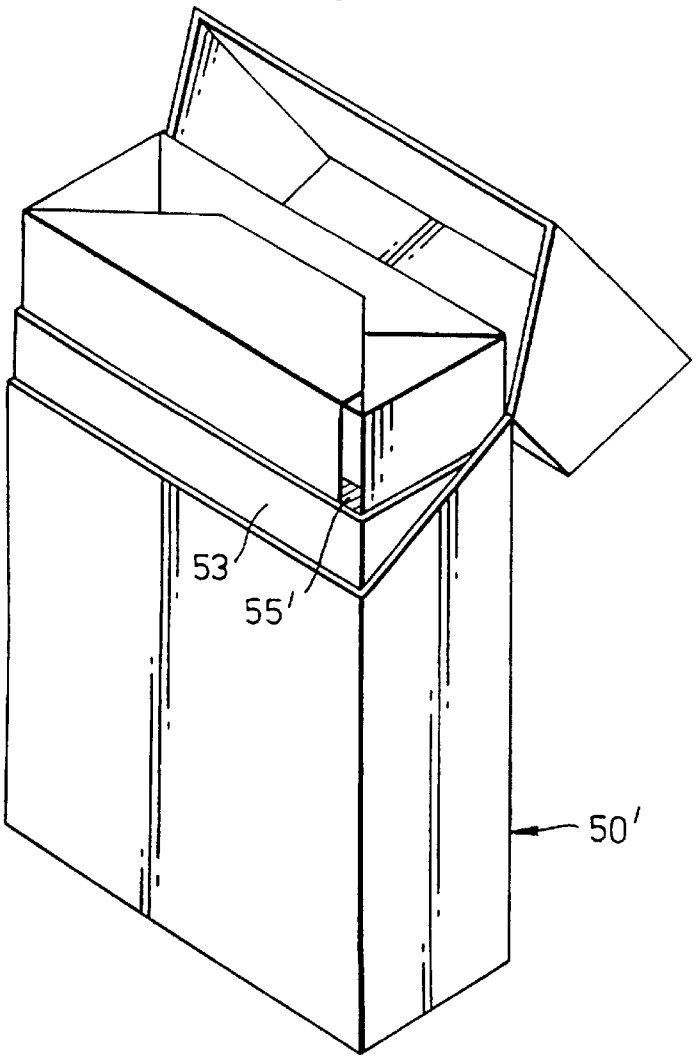
FIG. 7 is a perspective view of a third embodiment of package.
Figure 8:
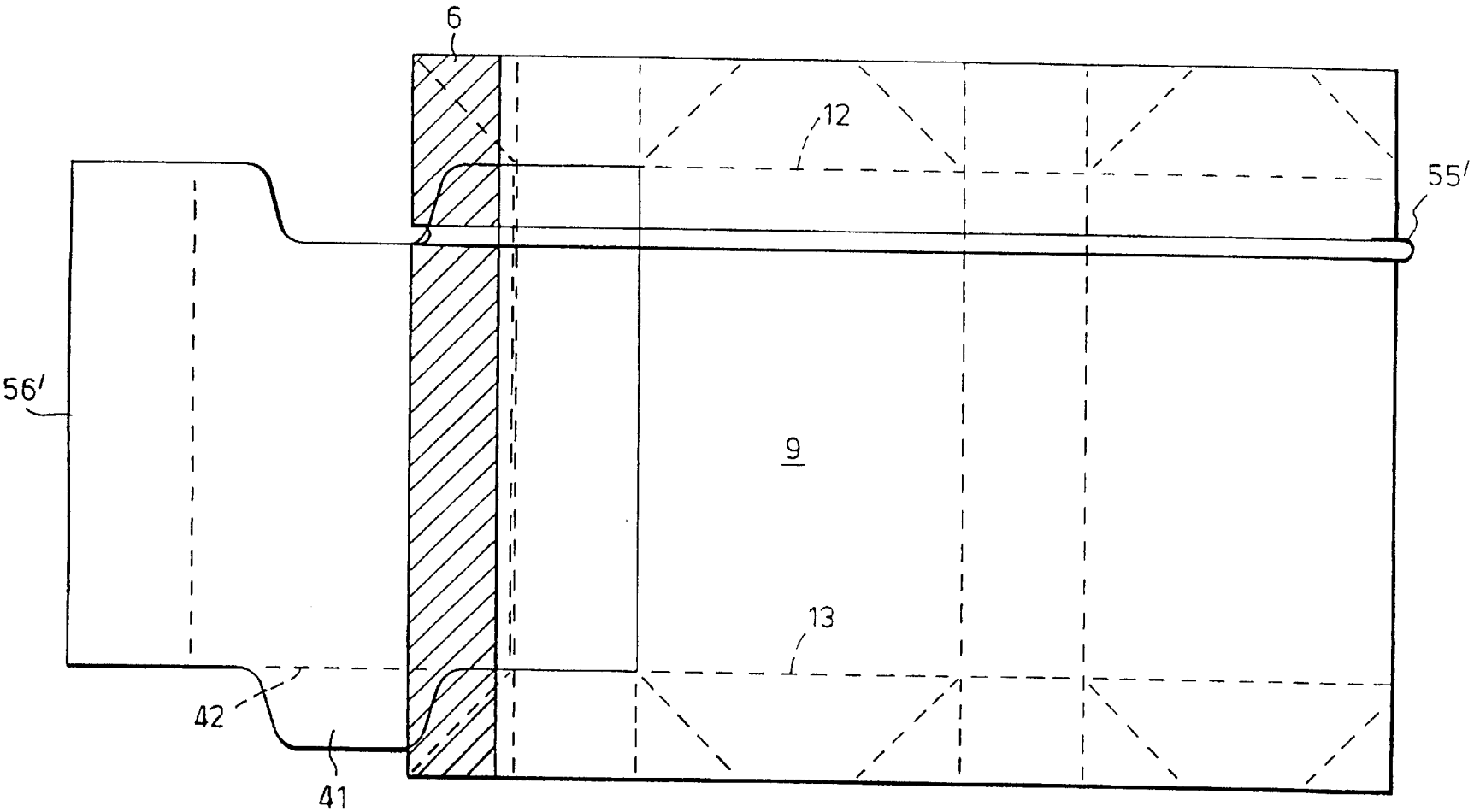
FIG. 8 is a face view of a third embodiment of the inner frame.

FIGS. 7 and 8 show how the pull tab 55' may be positioned closely adjacent to a front corner of the package 50. In FIG. 8, it will be seen that the sealable area 6 overlies an edge of the front panel of the inner member 56'. As compared to the embodiment of FIG. 6, the inner member 56' has greater length, so that it underlies the whole depth of the barrier material between fold ines 12 and 13. Lower projection 41 of the inner member 56' projects below fold line 13 but is itself defined by fold line 42; it is therefore folded in as the barrier material folding and sealing occurs. The advantage of this arrangement is that the whole side panel length of the heat-sealable area 6 is supported by the inner member 56'; also the folded-under projection 41 provides an additional floor for the cigarettes to rest on.

Figure 9:
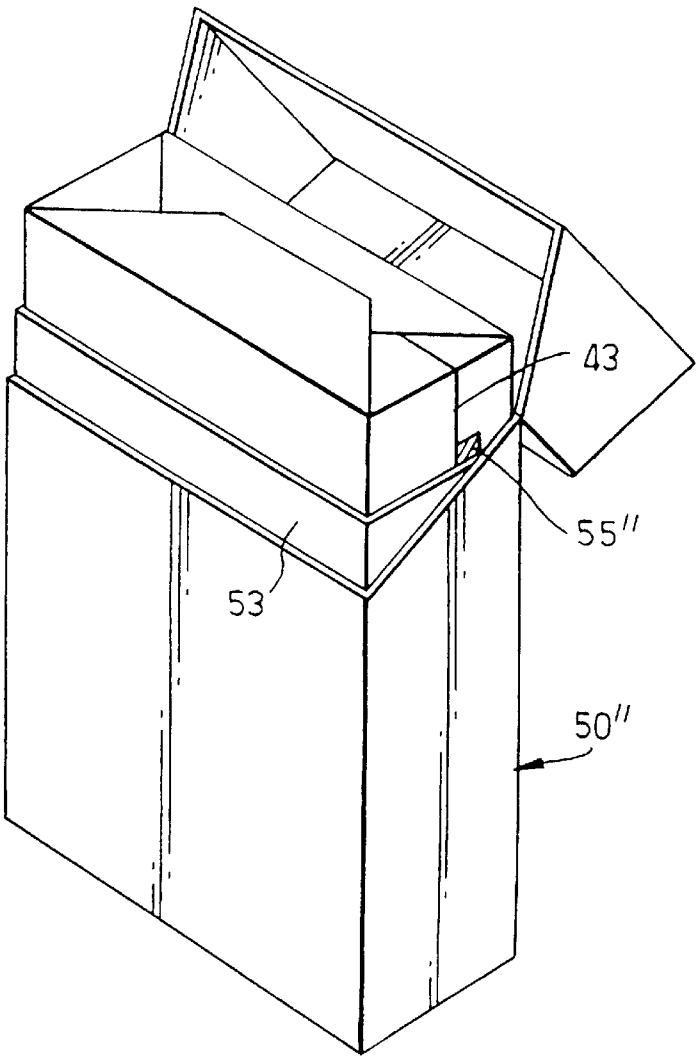
FIG. 9 is a perspective view of a fourth embodiment of package.
Figure 10:
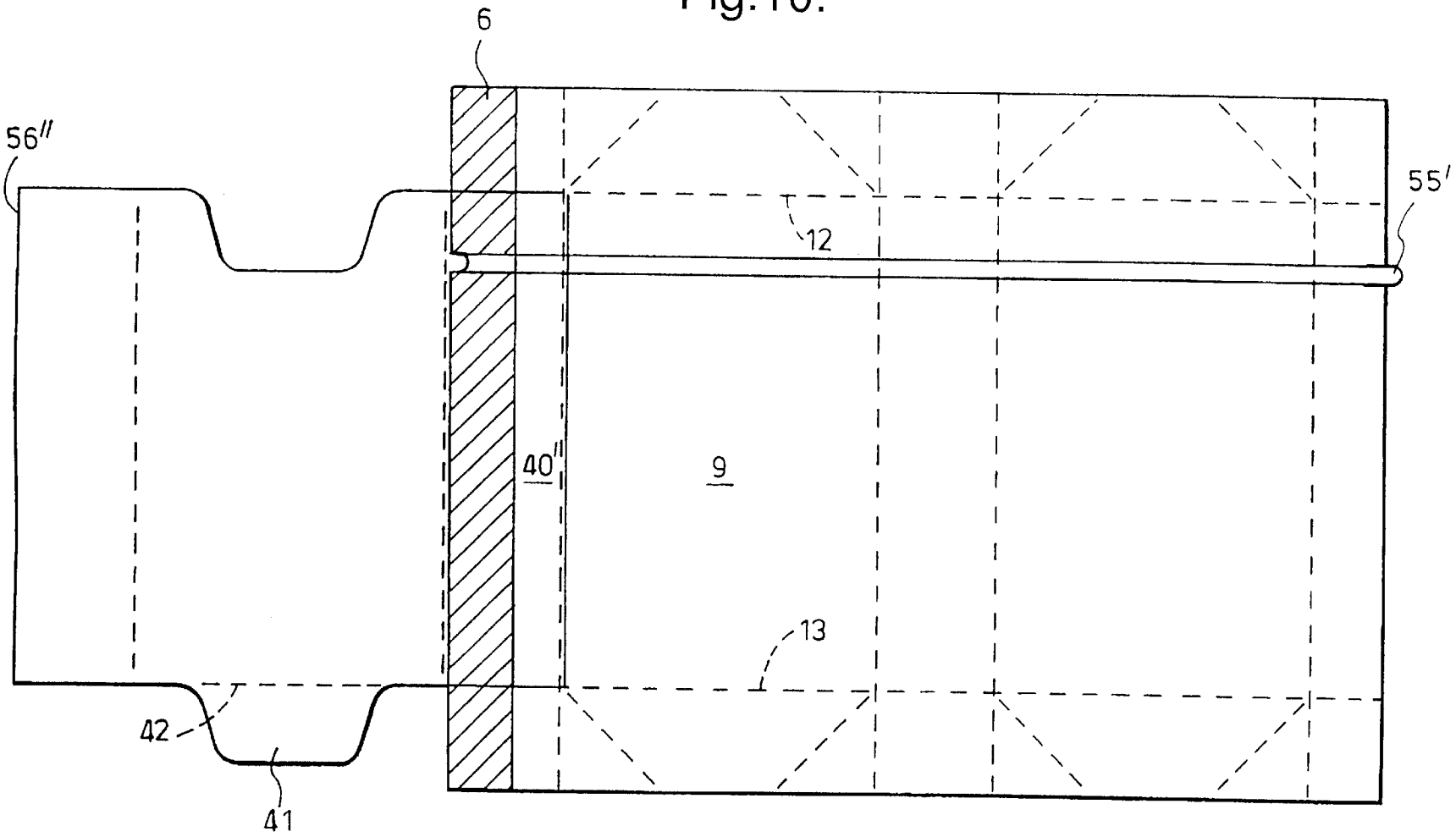
FIG. 10 is a face view of a fourth embodiment of the inner frame.
Figure 12:
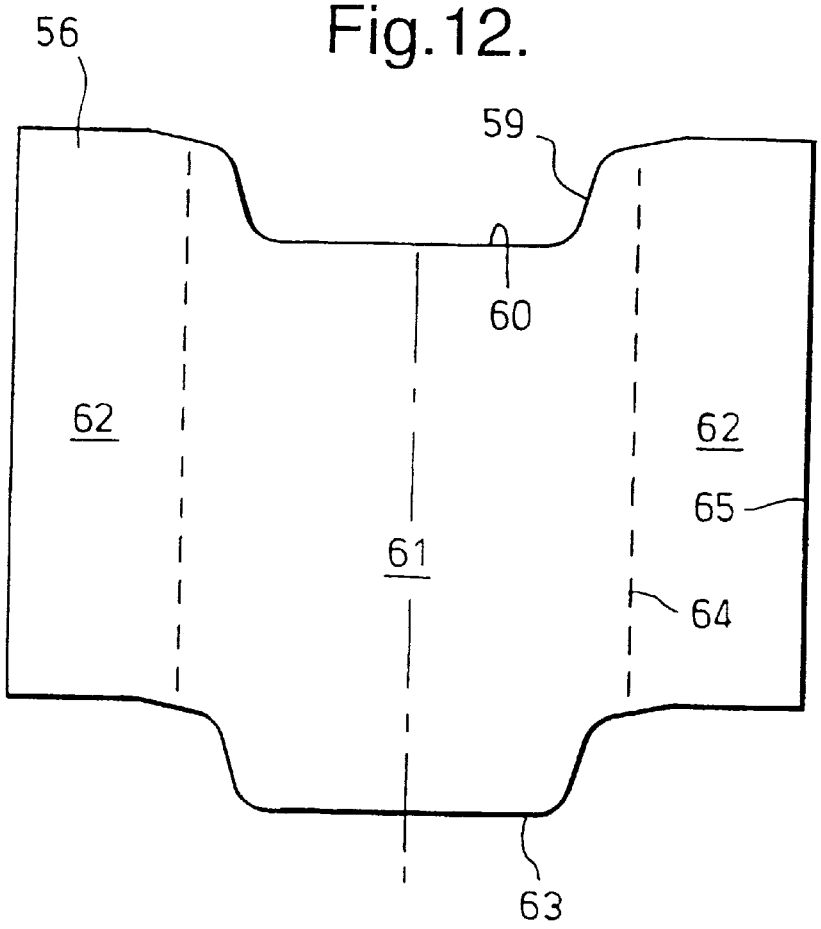
FIG. 12 is a face view of that inner member.

FIGS. 9 and 10 show how the pull tab 55" may be on a side wall of the package 50", at what becomes a side seam 43 of the sealed barrier enclosure. Here, the heat-sealable area 6 overlies a side wall 40' of the inner member 56". As in the third embodiment, the inner member extends under the barrier material for the whole length between fold lines 12 and 13, and inner member 56" has lower projection 41 and fold line 42.

Figure 11:
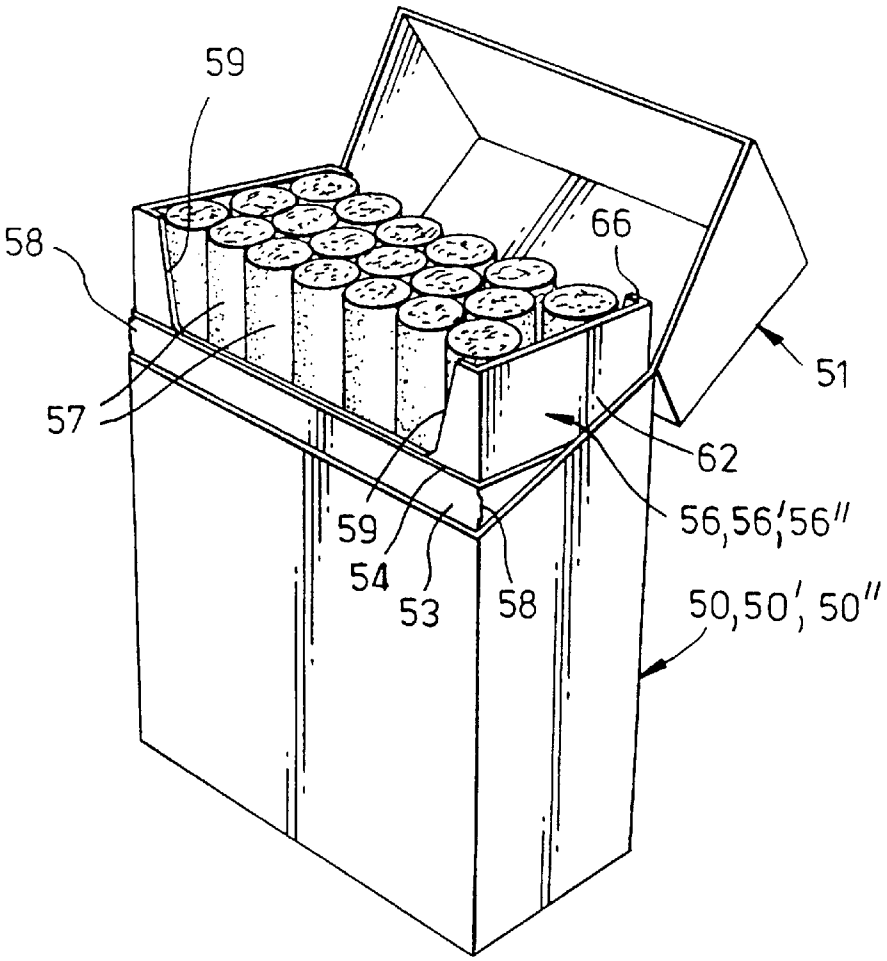
FIG. 11 is a perspective view of a carton with an upper portion of the barrier enclosure removed.

When the upper portion of any of these embodiments has been separated, the unobservant user will think that the pack is conventional in appearance (see FIG. 11). The observant user will however see that the inner frame has two members, an outer 53 and an inner 56,56',56" and that the barrier enclosure 52 was, and the remaining part of it still is, sandwiched in between them. A very thin line of the material of the barrier layer enclosure will be visible immediately adjacent the edge 54 of the outer member of the inner frame which provides the conventional ears 58 which assist in retaining that lid in the closed position.

The inner member 56,56',56" of the inner frame is immediately adjacent the edge of the collocation 57 of cigarettes in the packaging, here twenty of them; where the inner member 56 is absent these cigarettes are immediately surrounded by the material of the barrier enclosure 52.

The inner member 56,56',56" of the inner frame provides side walls 40 for the guidance of side walls of the lid 51 as that is closed onto the carton, and also the conventional-looking vee due to inclined walls 59.

The provision of the two members of the inner frame causes the carton to have a "feel" which is much more solid and robust to the touch than the conventional carton.

As is more clearly seen in FIG. 8, this inner member of the inner frame can be cut repetitiously from a single web of suitable card material to provide a portion forming a front panel 61 and two side wings 62.

The base 63 of the projecting vee is aligned with and will lie closely upon the floor of the barrier layer enclosure which is to be formed by folding at the lower fold line 13.

It will be seen that the side panels 62 are slightly wider between their fold lines 64 and extreme edge 65 than the distance between fold lines 2 and 3 of the blank, with the effect that when assembled the extreme rear edges of those side panels 62 will tend to be bowed slightly inwards as indicated at 66, FIG. 6 in a manner which is per se conventional and which is to help ensure that the side walls of the lid slide outside and not inside the side panels 62.

Figure 13:
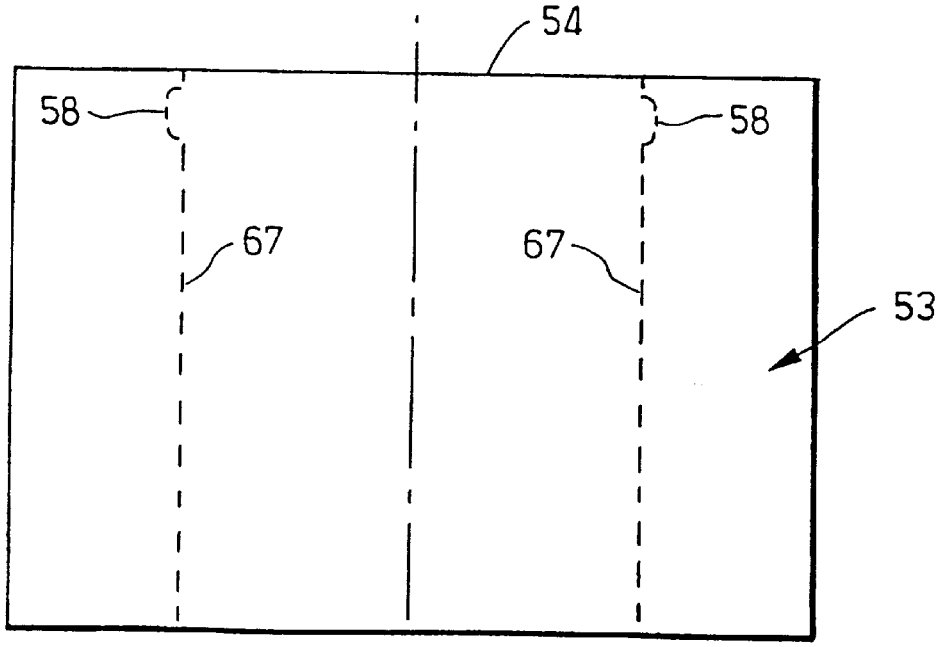
FIG. 13 is a face view of an outer member of the inner frame.

The outer member of the inner frame is a rectangle of card, as seen in FIG. 13, with fold lines 67 to overlie fold lines 2 and 5 of the barrier layer enclosure.

In one method of assembly, the inner member 56 will be preadhered to the blank 52 as indicated and the latter then inserted in a pocket known per se, charged with a collocation of cigarettes around which the barrier layer is then folded and sealed to form the barrier disclosure. The outer member of the inner frame is then assembled over the barrier layer before or at the same time as the enclosure containing the cigarettes is inserted into a made up carton or the carton blank is folded again in known manner around that assembly.

The previous embodiments have had a single side seam; it is equally possible for the barrier layer to be folded "lengthwise" over the cigarettes and sealed so as to have two side seams and a single envelope end. To open such a barrier enclosure a single tear strip or other line of separation would suffice, at the front of the pack; however, if it were desired to remove the whole of the upper portion of such an enclosure upon opening, a tear strip or the like provided on both major faces of the barrier enclosure and welded at the side seam could be provided.

We claim:

1. Packaging for smoking articles having a barrier layer and a carton with a major front face, a major rear face parallel to and spaced from the front face by side walls and a hinged lid at an upper end of the major rear face, edges of the barrier layer overlapping to form a sealed enclosure around a charge of the smoking articles in the carton and an edge of the major front face of the carton being aligned with and immediately adjacent a separation line of the barrier layer and being outside that layer, there being pull means associated with the barrier layer for allowing it to be pulled outwardly against the said edge of the major front face, said pull means including a tear stop extending around the charge of smoking articles from edge to edge of the barrier layer with one edge of the tear strip defining said separation line.

2. Packaging according to claim 1 wherein said edge of the major front face of the carton is provided by an inner frame member of the carton.

3. Packaging according to claim 2 wherein inner frame has inner and outer members, the barrier layer lying between them and the said edge of the major front face of the carton is of the outer member.

4. Packaging according to claim 3 wherein the inner member provides guidance shoulders for the lid of the carton as it pivots about the hinge.

5. Packaging according to claim 1 wherein the separation line is additionally defined by a line of weakening in the barrier layer.

6. Packaging according to claim 1 wherein the barrier layer is a metallized plastics material.

7. Packaging according to claim 1 wherein the barrier layer is a plastics/metal/plastics laminate wherein the metal and the plastics layer contribute primarily to the barrier effect.

8. Packaging according to claim 1 overwrapped with a further enclosure.

9. Packaging according to claim 7 wherein a line of weakening of the separation line is formed in the other of the plastics layers only.

10. Packaging for elongate smoking articles having a cuboid container with a front panel and a lid hinged to a rear panel thereof opposite to the front panel, said front panel and rear panel being spaced apart by side walls of the cuboid, a charge of the elongate smoking articles in said container, a sealed enclosure around said articles but inside said container being provided by a plastics/metal laminate, edges of said laminate overlapping to form a sealed seam running parallel to the axis of elongation of the smoking articles, a tear strip of said laminate extending from one said edge of the laminate to the other and one edge of said tear strip aligned with and immediately adjacent to an edge of the front panel of the container whereby an outward pull on a pull tab of the tear strip is for shearing the laminate against the said edge of the container.

11. Packaging according to claim 10 wherein the barrier layer is a plastics/metal/plastics laminate wherein the metal and one plastics layer contribute primarily to the barrier effect.

12. Packaging according to claim 11 wherein a line of weakening of a separation line is provided in the other of the plastics layers only.

13. Packaging according to clam 10 wherein one edge of the tear strip is aligned with and immediately adjacent to edges of the container at the front panel and side walls of the container.

14. Packaging according to claim 13 wherein said edges at the front panel and side walls of the container are provided by edges from inner frame of the container over which said lid closes.

* * * * *